US006296918B1

(12) United States Patent
Choi et al.

(10) Patent No.: US 6,296,918 B1
(45) Date of Patent: Oct. 2, 2001

(54) MOISTURE ABSORBENT SHEET MATERIAL HAVING AN INTEGRAL REFLECTIVE MEMBER

(76) Inventors: Si Young Choi; Seon Mee Bang, both of 606 S. Hill St. #405, Los Angeles, CA (US) 90014

( * ) Notice: Subject to any disclaimer, the term of this patent is extended or adjusted under 35 U.S.C. 154(b) by 0 days.

(21) Appl. No.: 09/481,795

(22) Filed: Jan. 12, 2000

(51) Int. Cl.[7] ..... B32B 3/02

(52) U.S. Cl. ..... 428/77; 428/99; 428/100; 428/912.2; 24/7

(58) Field of Search ..... 428/77, 99, 912.2, 428/100; 24/7

(56) References Cited

U.S. PATENT DOCUMENTS 4,411,467 * 10/1983 Cziptschirsch et al. ..... 428/77

* cited by examiner

*Primary Examiner*—Alexander S. Thomas
(74) *Attorney, Agent, or Firm*—Jerry H. Noh

(57) ABSTRACT

An improved napkin having an integral mirror surface comprising a first sheet of a pliable moisture absorbent sheet material and a second sheet defining a mirror surface. The second sheet is of a lesser portion of the first sheet. The sheet material of the first sheet can be of a cloth or paper material. The second sheet can be either permanently secured or removeably attached onto the first sheet.

9 Claims, 1 Drawing Sheet

MOISTURE ABSORBENT SHEET MATERIAL HAVING AN INTEGRAL REFLECTIVE MEMBER

BACKGROUND OF THE INVENTION

1. Field of the Invention

This invention relates to napkins and paper towels, and more particularly, this invention relates to napkins and paper towels having an integral mirror.

2. Description of the Prior Art

There are many different types of napkins and paper towels used to clean one's hand, face, or other body parts during or after a meal. A napkin can be made of cloth or of a paper material. Cloth napkins are mostly rectangular and are commonly placed on one's lap during a meal. Paper napkins, too are rectangular but are usually in a folded configuration and set on top of a table. Paper towels are usually rectangular and are packaged in rolls with perforations separating each paper towel.

During or after a meal, one uses a napkin or paper towel to clean oneself of any stains or food particles left on the hands or face. One can see his hands, but one cannot see his face. It would be convenient for one to be able to see his face when utilizing a napkin or paper towel. Women often carry compact mirrors in their purses, which they can use to see if they have any food around their mouth or on their teeth. Those who do not have a mirror often excuse themselves to a restroom to utilize a mirror therein. In the alternative, one can ask another to look at one's face to see if there is any food particles or stains thereon. There can be inconveniences in each of the above means of determining whether food is on one's face. First of all, men do not commonly carry portable mirrors, and it would be inconvenient for them to do so. Also, not all women carry portable mirrors. As for going to the restroom, it can be inconvenient for many to walk to a restroom just to look at one's face, and there are times when a restroom does not have any mirrors. Lastly, it can be embarrassing for many to ask another to see if a food particle or stain is stuck on one's face.

Most napkins and towels are flat sheets made of a uniform material such as cloth or paper. Some napkins have no designs and some have printed or quilted patterns or designs. However, none of the prior art discloses a napkin or paper towel having the features of the present invention.

SUMMARY OF THE INVENTION

It is a primary objective of the present invention to provide a napkin which allows a user to see one's face. It is another objective of the present invention to provide such a napkin which is relatively inexpensive and easy to manufacture.

The present invention is an improved napkin having an integral mirror surface. The improved napkin has a first sheet of a pliable moisture absorbent sheet material and a second sheet secured thereon. The sheet material of the first sheet can be of a cloth or paper material. The second sheet defines a mirror surface and is of a lesser portion of the first sheet.

The second sheet can be either permanently secured or removeably attached onto the first sheet. For a first sheet made of a paper material, the second sheet can simply be torn away by tearing the first sheet along the periphery of the second sheet. For a first sheet made of a cloth material, the second sheet can be removeably attached using a VELCRO hook and loop fastening means. In use, a person can use the second sheet as a mirror while using the first sheet as a napkin.

BRIEF DESCRIPTION OF THE DRAWINGS

With the above and additional objects and advantages in view, as will hereinafter appear, this invention comprises the devices, combinations and arrangements of parts hereinafter described, by way of example, and illustrated in the accompanying drawings of a preferred embodiment in which.

DETAILED DESCRIPTION OF THE PREFERRED EMBODIMENT

Figure 1:
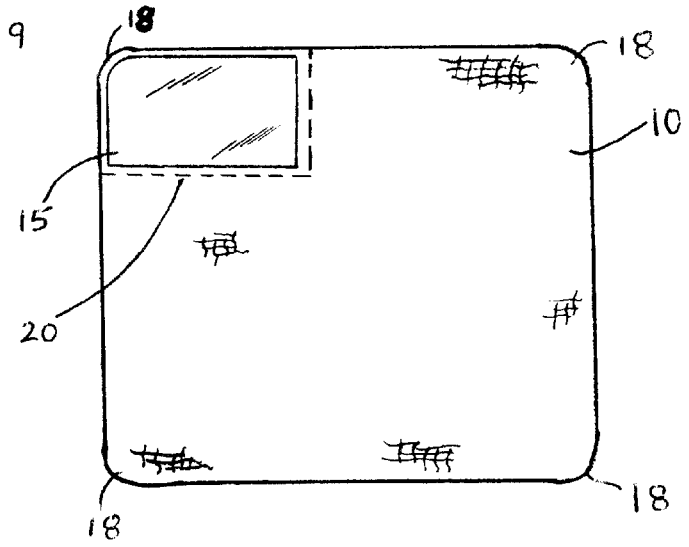
FIG. 1 is a top plan view of the present invention.
Figure 2:
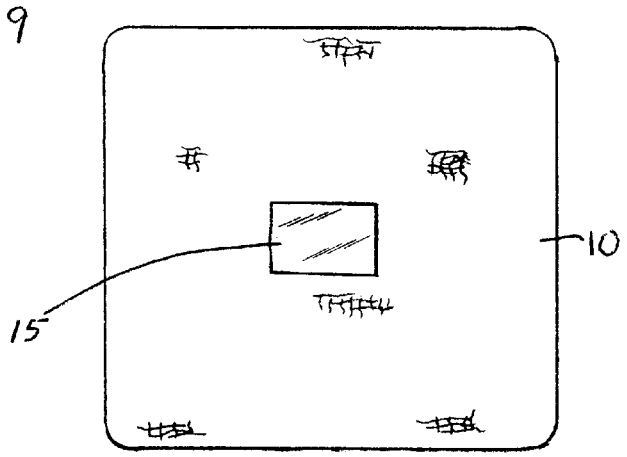
FIG. 2 is a top plan view of a second embodiment of the present invention.

The present invention as shown in FIGS. 1 and 2 is an improved napkin 9 comprising a first sheet 10 of a pliable moisture absorbent sheet material having a second sheet 15 secured thereon. The sheet material of the first sheet 10 can be a cloth made of linen or cotton or of any other material suitable for use as a napkin. In the alternative, the sheet material of the first sheet 10 can be of a paper material.

The second sheet 15 defines a mirror surface and is of a lesser portion of the first sheet 10. The second sheet 15 is less than approximately one eighth of the size of the first sheet 10. The second sheet 15 can be a relatively thin plastic substrate overlayed with a reflective metallic material. In the alternative, the second sheet 15 can be a reflective metallic material polished sufficiently to produce a mirror effect.

In the preferred embodiment as shown in FIG. 1, the first sheet 10 is rectangular and has four corners 18, and the second sheet 15 is secured at one of the corners 18. The dimension of the first sheet 10 can vary; however, in the preferred embodiment, the dimension is equivalent to the size of conventional napkins.

Figure 3:
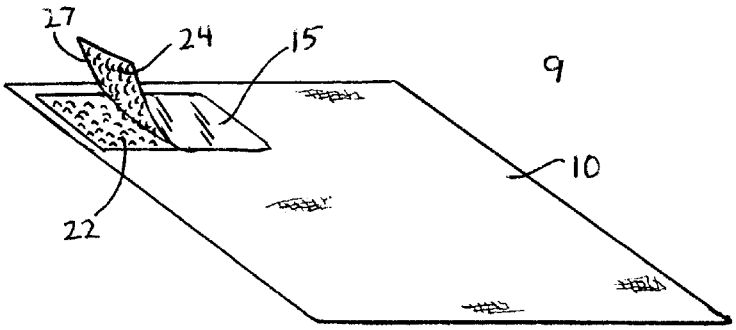
FIG. 3 is a perspective view of an embodiment of the present invention having the VELCRO hook and loop fastening means.

For those persons desiring to detach the second sheet 15 from the first sheet 10, another embodiment of the napkin 9 can be made so that the second sheet 15 is detachable. For a first sheet 10 made of a paper material, the second sheet 15 is secured to the first sheet 10 and can be torn away by the user. To ease the separation of the second sheet 15, a perforation 20 can be made on the first sheet 10 along the periphery of the second sheet 15. For a first sheet 10 made of a cloth material, the second sheet 15 can be removeably attached using a VELCRO hook and loop fastening means as shown in FIG. 3. A patch of VELCRO loop fastener 22 is permanently secured onto a predetermined portion of the first sheet 10, and a corresponding patch of VELCRO hook fastener 24 is permanently secured onto a bottom portion 27 of the second sheet 15. In use, a person can detach the second sheet 15, and wipe his face with the first sheet 10 while looking into the mirror surface of the second sheet 15.

While a preferred embodiment of the invention has been described and illustrated for purposes of clarity and example, it should be understood that many changes, substitutions and modifications to the described embodiment will be apparent to those having skill in the art in light of the foregoing disclosure without departing from the scope and spirit of the present invention which is defined by the claims which will follow.

What is claimed as being new and therefore desired to be protected by Letters Patent of the United States is as follows:

1. An improved napkin comprising:

a first sheet of pliable moisture absorbent sheet material;

a second sheet defining a mirror surface secured to the first sheet;

said second sheet being a lesser portion of said first sheet; and, wherein said first sheet is rectangular and has four corners, said second sheet being secured at one of said corners.

2. An improved napkin as described in claim 1 wherein said first sheet is made of a cloth material.

3. An improved napkin comprising:

a first sheet of pliable moisture absorbent sheet material;

a second sheet defining a mirror surface secured to the first sheet;

said second sheet being a lesser portion of said first sheet; and, wherein said first sheet is made of a paper material.

4. An improved napkin comprising:

a first sheet of pliable moisture absorbent sheet material;

a second sheet defining a mirror surface secured to the first sheet;

said second sheet being a lesser portion of said first sheet; and, wherein said second sheet is comprised of a layer of reflecting metallic material disposed on a plastic substrate.

5. An improved napkin as described in claim 4 wherein said first sheet is made of a cloth.

6. An improved napkin comprising:

a first sheet of pliable moisture absorbent sheet material;

a second sheet having a top portion and a bottom portion, said top portion defining a mirror surface, said bottom portion removeably attaching to said first sheet;

means to removeably attach said second sheet to said first sheet;

said second sheet being a lesser portion of said first sheet; and, wherein said means to removeably attach said second sheet to said first sheet comprises:

a patch of VELCRO hook fastener permanently secured to said bottom portion of said second sheet;

a corresponding patch of VELCRO loop fastener permanently secured to a predetermined portion of said first sheet; and, said patch of VELCRO loop fastener removeably attaching to said patch of VELCRO hoop fastener.

7. An improved napkin as described in claim 6 wherein said first sheet is rectangular and has four corners, said second sheet being secured at one of said corners.

8. An improved napkin as described in claim 6 wherein said first sheet is made of a cloth material.

9. An improved napkin as described in claim 6 wherein said second sheet is comprised of a layer reflecting metallic material disposed on a plastic substrate.

* * * * *